United States Patent [19]

Casey

[11] Patent Number: 4,582,121

[45] Date of Patent: Apr. 15, 1986

[54] APPARATUS FOR AND METHOD OF HEAT TRANSFER

[76] Inventor: Charles B. Casey, 816 N. Fourth St., Breese, Ill. 62230

[21] Appl. No.: 187,487

[22] Filed: Sep. 16, 1980

Related U.S. Application Data

[63] Continuation-in-part of Ser. No. 804,371, Jun. 9, 1977, abandoned.

[51] Int. Cl.[4] ..... F28D 15/00

[52] U.S. Cl. ..... 165/1; 122/33; 165/104.21; 165/104.26

[58] Field of Search ..... 165/104.21, 104.26; 122/33, 366

[56] References Cited

U.S. PATENT DOCUMENTS

| | | | |
|---|---|---|---|
| 502,728 | 8/1893 | Kreusler | 122/366 |
| 502,729 | 8/1893 | Kreusler | 122/366 |
| 1,725,906 | 8/1929 | Gay . | |
| 2,070,182 | 2/1937 | Saathoff | 122/33 |
| 2,119,091 | 5/1938 | Atkinson et al. | 122/33 |
| 2,350,348 | 6/1944 | Gaugler | 62/125 |
| 2,354,932 | 8/1944 | Walker et al. | 122/33 |
| 2,363,118 | 11/1944 | Chamberlain | 165/104.21 X |
| 2,985,707 | 5/1961 | Ahearn et al. | 165/104.26 X |
| 3,229,759 | 1/1963 | Grover | 165/105 |
| 3,344,979 | 10/1967 | Chester | 122/366 |
| 3,613,779 | 10/1971 | Brown | 165/133 |
| 3,621,906 | 11/1971 | Leffert | 165/104.26 X |
| 3,658,125 | 4/1972 | Freggens | 165/104.26 X |
| 3,853,112 | 12/1974 | Lazaridis | 165/104.26 X |
| 3,879,599 | 4/1975 | Kodaira | 165/104.26 X |
| 3,880,230 | 4/1975 | Pessolano et al. | 165/104.26 |
| 3,887,759 | 6/1975 | Staub et al. | 165/104.26 X |
| 3,902,046 | 8/1975 | Oi | 165/104.26 X |
| 3,924,674 | 12/1975 | Basiulis | 165/104.26 X |
| 3,967,093 | 6/1976 | Oi | 165/104.26 X |
| 3,968,787 | 7/1976 | Basiulis | 165/104.26 X |
| 3,977,364 | 8/1976 | Wilhelmus et al. | 165/104.26 X |
| 3,986,340 | 10/1976 | Blivins | 62/53 |
| 3,994,336 | 11/1976 | Pessolano et al. | 165/104.26 |
| 4,020,898 | 5/1977 | Grover | 165/105 |
| 4,072,183 | 2/1978 | Fraas | 122/33 X |

FOREIGN PATENT DOCUMENTS 22272 of 1892 United Kingdom .

OTHER PUBLICATIONS

"The Heat Pipe", G. Yale Eastman, Scientific American, May 1968.

*Primary Examiner*—Albert W. Davis, Jr.
*Attorney, Agent, or Firm*—Polster, Polster and Lucchesi

[57] ABSTRACT

Apparatus for the isothermal transfer of heat from a heat source to a heat absorber, the heat source and the heat absorber being enclosed within a container. A heat transfer working medium (e.g., a volatile liquid) is enclosed within the container and is capable of being efficiently vaporized on the surface of the heat source, being conveyed to the heat absorber, being condensed thereon, and being returned to the heat source. The quantity of the heat transfer medium contained in the container is sufficient to permit vaporization thereof on the surface of the heat source. A method of isothermal heat transfer is also disclosed.

10 Claims, 9 Drawing Figures

APPARATUS FOR AND METHOD OF HEAT TRANSFER

CROSS-REFERENCE TO A RELATED APPLICATION

This is a continuation-in-part application of Ser. No. 804,371 filed June 9, 1977, now abandoned.

BACKGROUND OF THE INVENTION

This invention relates to apparatus for and method (process) of transferring heat, and, specifically, relates to such apparatus and method for the isothermal transfer of large quantities of heat within a closed container.

Generally, this invention relates to heat exchangers and heat transport systems, and, more particularly, to change-of-state closed cycle heat transfer systems. Apparatus of this invention includes a closed container having, for example, tubes passing therethrough for carrying high and low temperature materials so as to serve, respectively, as a heat source and a heat sink or heat absorber. Such tubes are disposed within the container so as to be in heat exchange relation with one another by means of an intermediate working fluid which is alternately evaporated on the heat source tubes and condensed on the heat absorber tubes.

Heat exchangers generally can be divided into two main groups—conduction heat exchangers and change-of-state heat exchangers. Change-of-state heat exchangers have been known in the art for considerable time in the form of steam boilers, steam heating systems, vaporizers, thermo-syphons, vapor chambers, and the heat pipe. Of the various means of transmitting heat, the heat pipe is, in many respects, the most efficient and satisfactory. However, problems have been associated with the heat pipe in the design and development of a practical change-of-state vapor heat exchanger utilizing heat pipe principles.

To review briefly the history of the heat pipe, a closed cycle heat transfer system similar to a heat pipe was first disclosed in British Pat. No. 22,272 granted to Perkins et al on Dec. 5, 1892. In U.S. Pat. No. 1,725,906 granted to Frazer W. Gay on Aug. 27, 1929, a principal object of Gay's invention was to provide a form of heat transfer wherein a closed tubular element is provided within one end of which is a volatile liquid which, under the influence of heat conducted thereto through this one end, is caused to boil and to yield a hot vapor which rises to the opposite end of the tube at which point the vapor condenses. Then, the condensate moves back to the lower end of the tube under the influence of gravity. It is noted, however, that the lower end of the tube disclosed by Gay has a liquid level and, therefore, the device is more accurately classified as a thermo-syphon rather than a heat pipe.

In U.S. Pat. No. 2,350,348 granted to R. S. Gaugler on June 6, 1944, a device was disclosed in which a capillary element was placed within a pipe for the purpose of conducting or transporting liquid condensate back to the evaporator from the condensing section of the pipe even against the pull of gravity. Thus, Gaugler disclosed a method of transferring heat from a higher temperature to a lower temperature in any desired direction by evaporating a volatile liquid at a first point at a higher temperature, conveying the vapor to a lower temperature point, condensing the vapor on the lower temperature point, and returning, by capillary action, the condensed liquid back to the higher temperature point.

In U.S. Pat. No. 3,229,759 issued Jan. 18, 1966 to G. M. Grover, an evaporation-condensing condensation heat transfer device was disclosed which provided a thermal conductivity greatly exceeding that of any known metal by a large factor. Grover coined the term "heat pipe" to note a heat transfer device which within a closed tube or pipe, a liquid was evaporated in an evaporator section of the pipe, the vapor was transported through the pipe, and the vapor was condensed in a condenser section of the pipe with return of the condensate to the evaporator section being accomplished by a wick.

In its simplist form, a heat pipe is essentially a closed, evacuated chamber with a volatile liquid therewithin. At one end of the chamber, the evaporator section, the liquid is heating thereby causing it to vaporize. The resulting pressure difference between the evaporator section and the cooler end, referred to as the condenser section, forces the vapor (and thus the heat energy contained in the vapor) to move toward the condenser section. When the vapor reaches the condenser section, it encounters a lower temperature surface than that of the evaporator section (i.e., a temperature lower than its boiling temperature at the pressure within the container). As a consequence, the vapor condenses on the condenser section thereby releasing the energy stored therein (i.e., releasing the latent heat of vaporization). Once the vapor has condensed, the liquid condensate is returned to the evaporator section to complete the cycle.

It is important to note that the vapor stores heat energy at the temperature at which the liquid was evaporated, and that the vapor will retain that same temperature (and energy) until it meets a colder surface and condenses. This results in the entire chamber of the heat pipe remaining at a constant temperature (i.e., to be isothermal), and is responsible for the high thermal conductance properties of heat pipes.

The choice of composition and structure of the capillary materials used in the heat pipe for return of the liquid condensate from the condenser to the evaporator is dependent upon its compatibility with the working fluid and upon the working temperature of the heat pipe. Some known examples of capillary materials include copper, nickel, and aluminum porous or woven materials. In addition, certain ceramic fibrous materials may be used.

The working fluid used in a heat pipe is the actual heat transfer medium. The choice of heat transfer medium depends, to a large extent on the intended operating temperatures of the heat pipe. Generally, the medium must have a melting point below and a critical point above the heat pipe operating temperature. Such operating temperatures can be divided into a cryogenic range (i.e., less than 122° K.) in which liquid gases, such as nitrogen are used; moderate temperature ranges (122°-628° K.) in which materials such as methanol or water are used; and the liquid metal range (at temperatures greater than 620° K.) in which liquid metals such as potassium, lithium or sodium are used.

Generally, as the amount of surplus liquid in a heat pipe diminishes, the performance of the heat pipe improves dramatically. The heat pipe disclosed in Grover would appear to be the first true heat pipe because the quantity of working fluid is selected so that no surplus liquid is provided at the desired operating temperature of the heat pipe.

Reference may also be made to U.S. Pat. No. 3,613,779 to Clinton E. Brown in which it is stated that heat transfer in a liquid evaporation or condensation system is generally limited by the low thermal conductivity of the fluid relative to the thermal conductivity of the heat exchange surfaces of the system. Because the heat flux of a heat exchange surface is virtually proportional to the thickness of the fluid on the surface, the average thickness of the heat pipe flowpath through the fluid must be held to a minimum in order to maximize the heat transfer rate.

It is also generally recognized that in work producing thermodynamic or heat transfer processes, the ideal process is reversible. The measurement of the efficiency of a practical device or process is how close it comes to this ideal thermal reversible process. In thermodynamics, the closest approach to true thermal reversibility is the process of a vapor being condensed on a cold wall. In the cyclic heat pipe process of evaporation and condensation, the entire cycle becomes nearly reversible if the evaporation process substantially matches the reversibility of the condensation process.

It is also generally known that stable film evaporation can remove the heat from a surface at a rate several orders of magnitude larger than nucleate boiling or surface pool boiling. In high performance heat pipes, there is no nucleate boiling on the evaporator and the heat pipe is designed so that all heat transfer is stable film evaporation thereby to take advantage of the high heat flux properties of stable film evaporation.

As taught by Grover in his U.S. Pat. No. 4,020,898, the heat pipe is theoretically capable of transferring heat at much greater rates than conventional heat transfer systems because it operates on the principle of phase change rather than on the principle of conduction or convection. Grover also noted a number of difficulties had been experienced in attempting to use heat pipes in commercial applications. For example, Grover pointed out that heat pipes actually in operation typically utilized a capillary wick to transport the liquid longitudinally in the heat pipe from the evaporator section to the condenser section. In heat pipes using a wick, the quantity of working fluid is selected so that no surplus liquid is provided at the desired operating temperature. As a result there is only modest interference between the liquid and vapor phases of the working medium. However, capillary wicks were recognized to be difficult and expensive to install and for this reason the use of heat pipes incorporating such wicks has been limited to special and expensive application such as a nuclear reactors in spacecraft.

Attempts have been made to utilize the heat pipe principles in a single unit containing a heat source and heat absorber. U.S. Pat. No. 3,986,340 issued to Henry W. Bivens, Jr. in 1976, a closed system for gasifying liquid natural gas was disclosed and this system was based on the principle of heat transfer as used in heat pipes. However, this system was dependent upon gravity to return the condensate to a pool of working fluid in which the heat source was immersed. Vaporization took place at the surface of the pool of working fluid (as opposed to the surface of the heat source) and required that the entire pool of liquid be raised to its boiling temperature.

In the heat pipe, movement of the vapor is responsible for transporting heat energy from the evaporator section to the condenser section. This principle is, of course, the same as that used in conventional steam heating systems. What distingushes the heat pipe from such systems is not the capillary means which returns the liquid to the evaporator, but rather the stable film process on the surfaces of the evaporator. A stable film evaporation process combined with a stable film (or drop-wise) condensation process from a thermodynamic viewpoint, is nearly ideal for the fast and efficient transfer of heat. In his paper entitled "Heat Pipe" published in the May, 1968 "*Scientific American,*" G. Yale Eastman set out five important properties of heat pipes which are as follows:

First, heat pipes operate on the principle of vapor heat transfer and can have several thousand times the transfer capacity of metallic conductors.

Secondly, heat pipes exhibit a property called "temperature flattening". There are many heat transfer applications in which a uniform temperature over a large surface area is required. A heat pipe can be coupled to a non-uniform heat source so as to produce a uniform temperature at the output, regardless of the point-to-point variations of the heat source.

Thirdly, the evaporation and condensation functions of a heat pipe are essentially independent operations connected only by the flow of vapor and liquid within the container. The patterns and areas of evaporation and condensation are independent. Thus, the process occurring at one end of the heat pipe can take place uniformly or non-uniformly over large or small surface areas, without significantly influencing the process occurring at the opposite end of the heat pipe. This separation of functions leads to one of the most valuable properties of the heat pipe—its ability to concentrate or to disperse heat. This property has been called "heat flux transformation".

Fourthly, heat pipes have exhibited a property that makes it possible to separate the heat source from the heat sink. It is often inconvenient or undesirable to have the heat source and the heat sink in close contact within practical thermodynamic processes.

Lastly, heat pipes also can be operated so that the thermal energy and/or the temperature at which the energy is delivered to the intended heat sink be held constant in spite of large variations in the energy input to the heat pipe. This surplus power beyond the needs of the heat sink can be dissipated by means of an excess power radiator or condenser.

Generally, limitations of heat pipe-based technology have been due to design. Heat pipes are generally point-to-point heat transfer apparatus as contrasted with area-to-area apparatus. A number of individual prior art heat pipes have combined in a bundle so as to result in an apparatus which can be effectively used to transfer heat in volume. In these prior art heat pipe designs, however, the ends of the individual heat pipes often times project into the heat source and heat sink fluid thus creating restriction and turbulence which restricts the flow of these fluids. Further, in conventional heat pipe designs, the evaporator surfaces and condenser surfaces share their operating areas with the walls of the heat pipe structure. To increase or decrease the functional or operating areas of the evaporator and condenser sections, the wall structure of the heat pipe has to be expanded or otherwise distorted. Further, in a heat pipe, the energy recovered from the heat source is a function of the area of the evaporator surface on the wall of the heat pipe and the heat delivered is a function of the volume of the interior of the heat pipe. In expanding the size of the heat pipe container, the inside volume increases at a rate much faster than that of the wall area. It would be of no real value to expand the size of the heat pipe without means for increasing the evaporator area.

Heretofore, there have been many formidable barriers and severe limitations inherent in prior art heat pipe designs which are overcome by the apparatus and method of the present invention as will be hereinafter described in detail.

Reference may be made to such other U.S. patents as U.S. Pat. Nos. 2,119,091, and 2,919,551 in the same general field as the instant invention.

SUMMARY OF THE INVENTION

Among the several objects and features of the present invention may be noted the provision of apparatus for and a method of heat transfer which utilizes all five of the principal properties of a heat pipe in a practical and usable system;

The provision of such apparatus and method in which greatly increased efficiency of high heat transfer fluxes at relatively isothermal operating condition is achieved;

The provision of such apparatus and method which provides area-to-area heat transfer in contrast to point-to-point heat transfer in many present heat pipe designs;

The provision of such apparatus and method in which the evaporation or vaporization process approximately equals the condensation process in both speed and reversibility;

The provision of such apparatus and method in which the heat source constituting the evaporator can be made smaller in size because of the high rate of vaporization on the heat transfer surfaces of the heat source;

The provision of such apparatus and method in which the evaporation process on the heat source is one of stable film evaporation;

The provision of such apparatus and method in which the circulation of the heat exchange medium within the apparatus is maximized;

The provision of such method and apparatus in which the temperature can be controlled within itself;

The provision of such apparatus and method which is able to operate at relatively low pressures thus alleviating the necessity of engineering structures containing the apparatus and method which are capable of withstanding high vapor pressures;

The provision of such heat transfer apparatus and method which is able to operate independently of gravity and which requires no expenditure of energy to circulate the working or heat transfer medium;

The provision of such apparatus and method which has its own heat source and heat absorbing means therewithin allowing the apparatus to be designed as a whole and allowing optimization of the materials and surface area ratios for the particular task intended for the apparatus;

The provision of such apparatus and method which enables the transfer of large quantities of heat between two or more bodies at essentially constant temperatures;

The provision of such apparatus and method which, to a large degree, eliminates or substantially reduces the effects of changes of temperature, pressure, fluid flow, non-uniform temperature distribution, and mass transfer within the heat transfer apparatus;

The provision of such apparatus and method in which there is no substantial accumulation of materials within the apparatus so as to interfere with the heat exchange;

The provision of such apparatus and method which, because of the liquid and vapor phases of the working fluid remain at substantially constant temperature, is substantially internally reversible;

The provision of such apparatus and method in which the heat conductance area of the apparatus of the instant invention can be several orders of magnitude larger than with prior heat transfer apparatus and methods;

The provision of such apparatus and method in which extremely high heat transfer coefficients (e.g., 35,000 B/Hr./Sq. Ft./°F. for water) are present;

The provision of such apparatus and method in which the temperature gradients within the heat source and in the walls of the heat source are removed by vaporization of a working fluid;

The provision of such apparatus which is easy to clean and maintain;

The provision of such apparatus in which the geometric shape of the heat source and of the heat absorber does not substantially affect the operation or efficiency of the apparatus;

The provision of such apparatus and method in which the heat exchange between multiple, unmixable fluids can be integrated in a single heat exchanger; and The provision of such apparatus and method in which the walls of the isothermal container of the apparatus of the present invention can be readily insulated on either the inside or the outside so as to prevent radiation losses and thermal gradients which result in thermal irreversibilities.

Other objects and features will be in part apparent and in part pointed out hereinafter.

Briefly stated, the heat transfer apparatus of the present invention comprises a closed container within which is contained a heat source including one set of tubes having a heated medium flowable therethrough and having one or more heat transfer surfaces thereon, and a second set of tubes located apart from the first set of tubes, the second set of tubes having another medium flowable therethrough and constituting heat absorbing means. A heat transfer working medium is enclosed within the container which is capable of being vaporized on the surfaces of said first set of tubes, being condensed on the surfaces of said second set of tubes, and being conveyed back to the surface of the heat source to the surfaces of the first set of tubes. The quantity of heat transfer working medium within the enclosed container is that which is sufficient to permit vaporization directly of the working medium on the surfaces of the first set of tubes.

Equally broadly stated, the method of the present invention for transferring heat contemplates a closed container having two sets of tubes located therewithin, the first set of tubes having a material flowable therethrough and constituting a heat source and the second set of tubes having another material flowable therethrough and constituting a heat sink. A heat transfer working medium is also contained within the closed container. Specifically, the method of this invention is defined to comprise the steps of vaporizing the heat transfer working medium on the surfaces of the first set of tubes, conveying the vaporized working medium to the second set of tubes, and condensing the vapor thereon. Then, the condensed working medium is returned to the surfaces of the first set of tubes.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
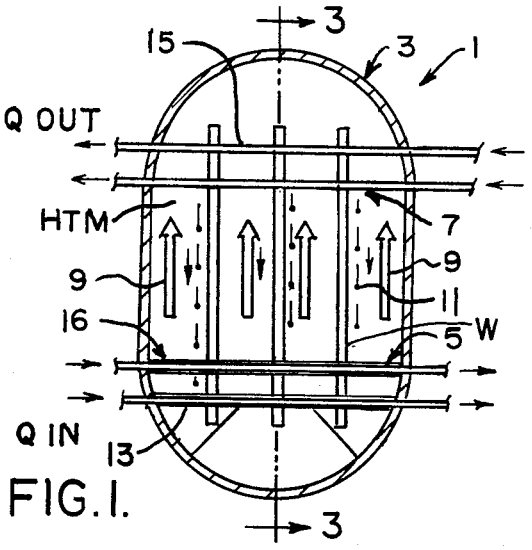
FIG. 1 is a semi-diagrammatic view of apparatus and method of the present invention depicting a closed container having a first set of tubes therein constituting a heat source, a second set of tubes spaced apart from the first set of tubes and constituting a heat sink, and a working medium contained within the container which is vaporized on the surfaces of the first set of tubes, and, in which the resulting vapor flows toward the heat sink (as indicated by the open arrows) and in which vapor condenses on the surfaces of the second set of tubes and the liquid condensate (as shown by the droplets) is returned to the first set of tubes.
Figure 2:
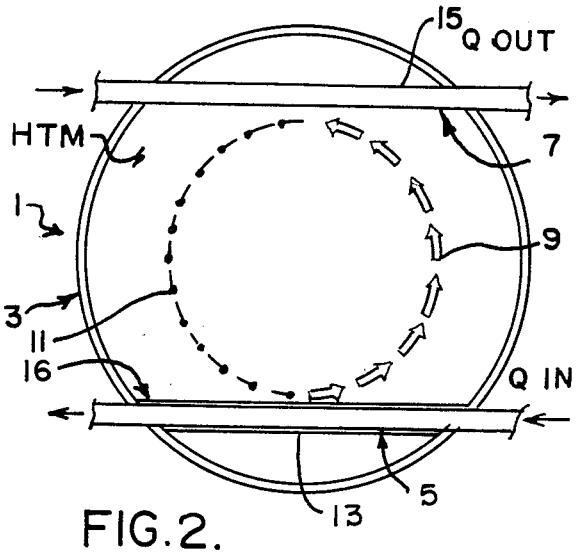
FIG. 2 is a diagrammatic representation of the method or cycle of the present invention illustrating a closed container with two sets of tubes therein and with the working medium being vaporized on the first set of tubes, being conveyed to the second set of tubes and being condensed thereon with the liquid condensate being returned to the first set of tubes.
Figure 3:
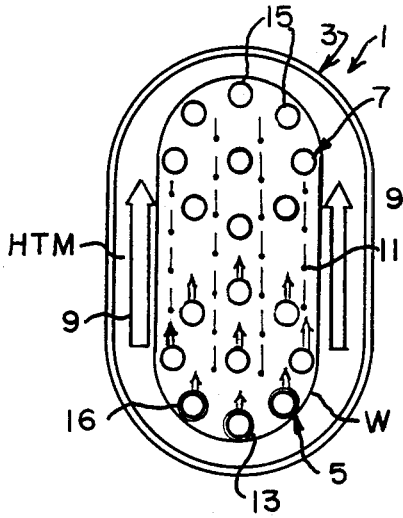
FIG. 3 is a cross-sectional view taken along line 3—3 of FIG. 1 having two mutiple tube sets of tubes or conduits therewithin constituting the heat source and heat sink and showing the wicking in front elevation.

Referring now to the drawings specifically to FIGS. 1–3, the basic concept of the apparatus and method of the present invention is, perhaps, best illustrated. In FIG. 1, the apparatus of this invention is indicated in its entirety by reference character 1. The apparatus is shown to include a closed container, such as generally indicated at 3, having two sets of tubes, as generally indicated at 5 and 7, passing through the walls of the container with the sets of tubes being spaced apart from one another. The first set of tubes, as indicated at 5, constitutes a heat source and is adapted to have a heated medium (referred to as a high termperature medium) conveyed therethrough, as indicated by the designation $Q_{in}$. The other set of tubes, as indicated at 7, constitutes a heat absorber or heat sink and is adapted to have another medium (referred to as a lower temperature medium) conveyed therethrough for carrying away heat, as indicated by the designation $Q_{out}$. In accordance with this invention, a suitable heat transfer working medium or fluid HTM is also contained within container 3. While this working medium may take on many forms, it is preferable that the heat transfer working medium be capable of being vaporized on the surface of the heat source, that the vapor be conveyed to the heat sink, as indicated by arrows 9, be condensed on the surface of the heat sink, and that the liquid condensate, as indicated by droplets 11, be returned to the heat source for completing the cycle. It will be understood that the selection of the materials from which the container, heat source, heat sink, and working medium are constructed or formulated will be a matter of design choice, depending on the heat transfer rate, operating temperatures etc. of the particular application for the apparatus of the present invention. In discussing particular embodiments of the present invention hereinafter, examples of preferred materials will be disclosed.

It will be understood that the heat source 5 and that the heat absorber 7 each include a respective heat transfer surface, as indicated at 13 and 15. These heat transfer surfaces may include not only the surfaces of the tubes 5 and 7, but may include additional heat transfer surfaces, such as fins and the like. It will be understood that herein when the terms "tubes" or "sets of tubes" are used to describe the heat source or sink, and when it is stated that the fluid HTM is evaporated or condensed "on the tubes", the evaporation or condensation may be carried out on any surface in heat transfer relation with the tubes. It is further understood that if the additional heat transfer surfaces are present, they may take on any desired configuration or shape. It also to be understood that, within the broader context of the invention, the heat transfer surface areas of the heat source and the heat sink need not be equal.

Also, means other than gravity may be provided in apparatus 1 to return the liquid heat transfer working medium from the heat sink to heat source 5. For example, as shown in FIGS. 1 and 3, sheets of a suitable capillary wicking material W capable of transporting the liquid heat transfer medium from the heat sink to the heat source may be provided. However, in other designs, baffles and return tubes (not shown) may be provided to return the liquid condensate to heat source 7.

In FIG. 2, the method of heat transfer of the present invention is schematically depicted. As shown by the open arrows, as indicated at 9, the heat transfer working medium HTM is vaporized on the heat transfer surfaces 13 of tubes 5 (preferably by surface film evaporation) and the vapor is conveyed or transported to the heat transfer surfaces 15 of the heat absorbing tubes of 7. This transport of vapor is indicated by arrows 9. The transport of the vapor is caused by a change in pressure within the container 3 due to a slight temperature difference between the heat absorbing tubes 7 and the heat source tubes 5. Upon the vapor contacting the relatively cool surfaces 15 of the heat absorbing tubes 7, the vapor condenses thereon and the liquid condensate, as indicated by droplets 11, returns to the evaporation or heat transfer surfaces 13 of the heat tubes 5. In FIG. 2, this vaporization, condensation, and return of condensate cycle is illustrated by the circular flow of arrows 9 and droplets 11. The return of condensate may be through the capillary action of wicking material (not shown in FIGS. 1 and 2) which conveys the liquid condensate by capillary action or, the liquid condensate may be returned to the evaporation surfaces of the heat source by means of gravity, pumps, or the like.

Generally speaking, FIG. 2 is a schematic of the method of this invention illustrating that the process is continuous with the rate of evaporation being dependent on the rate of condensation and with the rate of condensation being dependent on the rate of evaporation. The circular pattern of arrows 9 and 11 in FIG. 2, depicts that the faster the rates of evaporation and condensation, the greater the rate of heat transfer from heat source 5 to heat sink 7. If impediments to evaporation (e.g., a bath of liquid covering tubes 5) or impediments to evaporation or to the return of the condensate are present, the efficiency and rate of heat transfer of the process of this invention may be adversely affected.

Preferably, the evaporation or heat transfer surface 13 of heat source 5 is provided with means, as generally indicated at 16, for uniformly distributing the liquid condensate over the heat transfer surfaces of the heat source tubes so as to promote stable film evaporation on all heat transfer surfaces of the heat source. Distribution means 16 may be supplied with liquid condensate from wicking means W. For example, a fibrous ceramic material, such as is commercially available from the Metals Division, Hitco subsidiary of Armco, Inc. of Gardena, Calif., under the trademark Refrasil, applied to the outer surfaces of tubes 5 may be satisfactory in certain applications. In other instances the tubes may be provided with an intergal metal foam material of the same metal as the tube. In addition, suitable capillary wicking material, sump pumps, flow channels and baffles may be provided to direct and to distribute the returning liquid condensate over the heat transfer surfaces 13 of the heat source. Of course, it will be understood, that, by the nature of the condensation process on the heat absorbing surfaces 15 of the heat sink 7, the vapor will naturally seek out these surfaces and no specific means need be provided to insure the uniform condensation of the vapor on the heat transfer surfaces 15 of the heat sink.

It will be particularly noted in FIGS. 1 and 2, that heat source 5 is not immersed or otherwise submerged under a body of liquid heat transfer medium HTM, and thus, surface film evaporation of the heat transfer medium on the heat transfer surfaces of the heat source is insured. In accordance with this invention, the stable film evaporation of the heat transfer medium insures exceedingly high rates of thermal conductance from the heat source to the heat transfer working medium. Also, the stable surface surface film evaporation of the heat transfer medium on the surface of the heat source approximates a truly reversible thermal process and thus the stable film evaporation is highly efficient and is nearly ideal from a thermodynamic viewpoint. Likewise, the point or dropwise condensation of the vapor on the relatively cool surfaces 15 of heat sink tubes 7 is nearly reversible and thus is also highly efficient. As noted above, it is a primary object of the apparatus and method of the present invention to provide a workable process or method and a workable apparatus which approaches the ideal reversible thermal process. From the above, it is seen that applicant's apparatus and process achieves these objects.

In FIG. 3, apparatus 1 of this invention is again illustrated as a closed container 3 having a heat source 5 and a heat sink 7 contained therewithin with a suitable heat transfer working medium, as indicated by vapor phase by arrows 9 and as indicated in liquid phase by droplets 11. In FIG. 3, both the heat source 5 and heat sink 7 are shown to be constituted by bundles or sets of tubes (shown in end view in FIG. 3) passing through the interior of container 3 and carrying suitable high and low termperature heat transfer mediums therethrough. As shown in FIG. 3, the sets of tubes each contain a plurality of tubes, but, within the broader aspects of this invention, the term "set of tubes" is herein defined to include one or more tubes. In FIG. 3, wicking means W is shown in front elevation as a sheet of wicking material adapted to have liquid condensate fed onto it from tubes 7 and to transport the liquid condensate back to the heat source tubes 5 for being distributed by distribution means 16.

From a thermodynamic view, the present invention is a closed system containing a non-flow heat transfer fluid similar to the non-flow fluid of a Carnot engine. Into this passive system, high and low intensity substances are introduced which immediately seek to level their intensities by means of an intermediate isothermal fluid, not to be displaced from equilibrium, which is in heat exchange relation with the high and low intensity substances. All temperature gradients are in the high and low intensity heat bearing substances and in the walls that enclose them. The value of this is that entropy increase and corresponding loss of availability is held to a minimum and is directly related to the speed at which the exchange system operates.

Figure 4:
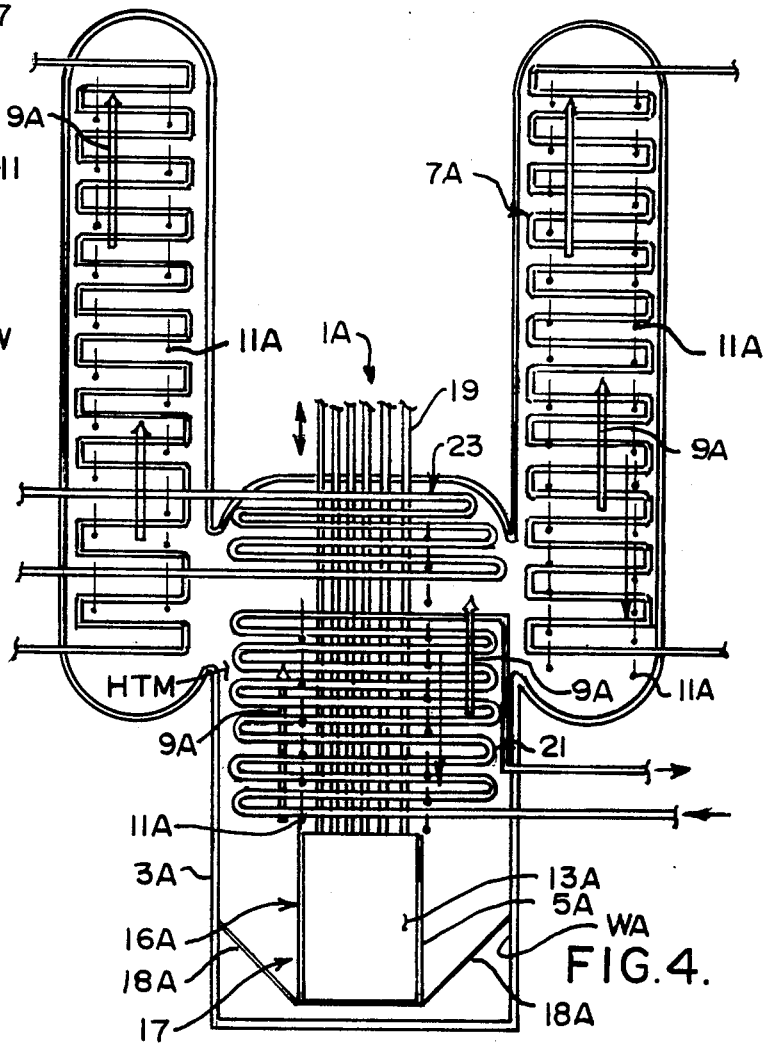
FIG. 4 is a semi-diagrammatic view of a nuclear fission reactor wherein the reactor core constitutes the heat source and wherein various sets of tubes having a cooling medium flowing therethrough represents the heat sink.

Referring now to FIG. 4, a specific embodiment of applicant's invention, as generally indicated by reference character 1A, is shown to comprise a nuclear fission reactor from which heat may be extracted for the production of electricity or the like. The reactor is preferably contained within a closed container, as indicated at 3A, a nuclear reactor, as generally indicated at 17, is contained within container 3A. This nuclear reactor constitutes an exothermal (i.e., heat is given off) heat source as generally indicated at 5A. The nuclear reactor, of course, contains within its core a suitable quantity of fissionable materials. As is conventional, a plurality of control rods, indicated at 19, is selectively movable in and out of the reactor core for regulating or modulating the nuclear reaction. It will be understood that the construction of the apparatus shown in FIG. 3 merely illustrates the principles of the apparatus and method of the present invention. The reactor core is provided with a heat transfer surface 13A which may utilize interior tubes or the like to increase the surface area of the reactor for heat transfer and the interior of the container 3A contains a quantity of heat transfer medium, such as a suitable liquified metal (e.g., lithium). The liquid lithium is vaporized on the heat transfer surfaces 13A of nuclear reactor core 17 and the vaporized lithium, as indicated by arrows 9A, then migrates toward the condensation or heat sink areas of the apparatus. In this instance, the heat sink 7A is constituted by sets of tubing having a suitable heat transfer material, such as pressurized helium, flowing therethrough. The vaporized lithium, of course, condenses on the surfaces of the heat sink tube set and transfers the latent heat of condensation of the vaporized lithium to the helium flowing through the tube set 7A. This, of course, heats the helium which can be utilized to drive an electric generator or the like (not shown) in a manner similar to known high temperature helium cooled reactors. Liquid lithium condensate, as indicated by droplets 11A, returns to the reactor by means of return means WA.

As illustrated in FIG. 4, the heat sink or heat absorbing pipes 7A may be located remotely from the nuclear reactor core and, in accordance with the general operating principles of heat pipes, the vaporized heat transfer medium (i.e., the vaporized lithium) will be conveyed to the site of the heat sink within the container. The liquified condensate (lithium) then may return by gravity through various ducts and flow passages 18A which constitutes return system WA. The condensate is then distributed over the evaporation surfaces 13A of nuclear reactor 17.

As indicated generally by reference characters 21 and 23 in FIG. 4, auxiliary sets of condensation coils or tubes are provided within container 3A. Like heat absorber 7A, these sets of tubes 21 and 23 have a heat transfer substance selectively circulated therethrough. The purpose of these auxiliary heat absorbing surfaces 21 and 23 is to insure that the heat given off by nuclear reactor core 17 can be absorbed or dissipated without an adverse or abnormal increase in temperature of the nuclear reactor core or of the space within container 3A. As shown, these auxiliary heat absorbing tubes 21 and 23 are intermediate to the heat source 5A (e.g., nuclear reactor 17) and the heat sink 7A. Thus, these auxiliary sets of tubes will, when a heat transfer substance is conducted therethrough, absorb heat from the heat source and will thus regulate the flow of vapor from the heat source to the heat sink 7A. In this manner, any quantity of heat given off by the heat source which is in excess of the capability of heat sink 7A to absorb will be absorbed by the auxiliary sets of heat absorbing tubes 21 and 23. Thus, these auxiliary sets of heat absorbing tubes constitute means for regulating the flow of the heat transfer medium vapor from the heat source to the heat sink.

It will be further understood that, in accordance with this invention, the auxiliary sets of heat absorbing tubes are not active, that is, they do not normally have a maximum quantity heat conducting fluid circulating therethrough. However, in the event the temperature within container 3A exceeds a predetermined limit, a valve (not shown) can be opened to permit the maximum flow of fluid through tubes 21 and 23. As this heat absorbing fluid flows through tubes 21 and 23, excess heat given off by heat source 5A will be absorbed and thus the total amount of heat given off by the heat source will be approximately equal to the heat absorbed by not only heat absorbing means 7A but also by the auxiliary heat absorbing or regulating means.

By insuring that the reactor has excess condensation capacity, heat given off by reactor core 17 is removed at a high rate, and is efficiently removed from container 3A via tube sets 7A, 21 and 23. Further, the liquid condensate is returned to the reactor core at such a rate as to maintain the high rate of heat removal. This process not only works well during normal reactor temperature excursions, but constitutes an emergency cooling system for the reactor.

Of course, the various circuits for circulating heat transfer fluid through the auxiliary circuits can be made independent of the circuits for circulating the heat transfer fluid through heat absorber 7A to increase the safety of the nuclear reactor system.

Figure 5:
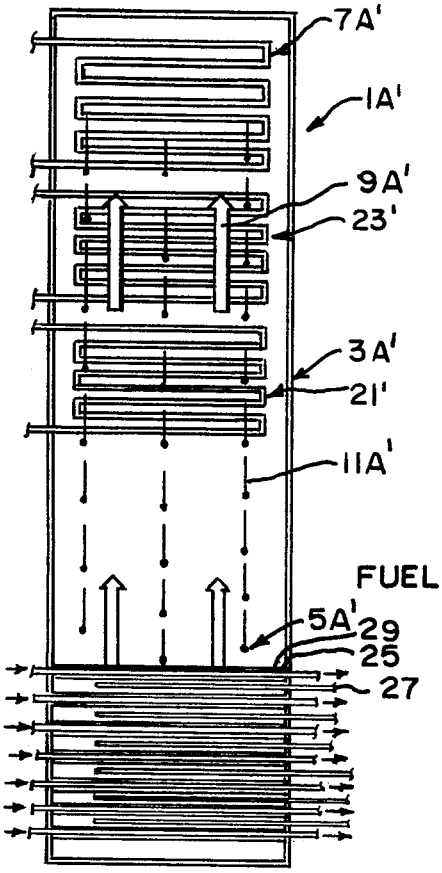
FIG. 5 is another embodiment of a nuclear reactor in which the reactor core is constituted by a set of tubes within the container of the heat transfer apparatus of the present invention with each of the tubes having a capillary surface thereon and with each of the tubes containing nuclear fuel for supporting the nuclear reaction.

Inherent in the nuclear reactor system shown in FIGS. 4 and 5, is that with a liquid metal heat transfer medium, the pressure of the liquid metal, as it is vaporized and condensed within container 3A, remains relatively low and thus the container enclosing the nuclear reactor need not be a pressure vessel. This will enhance the safety of the nuclear reactor system utilizing the heat transfer apparatus and method of the present invention.

Referring now to FIG. 5, a modification of the nuclear reactor shown in FIG. 4 is indicated in its entirety by reference character 1A'. In FIG. 5, this modified version is shown to include a closed container 3A' having a heat source (nuclear reactor) 5A' and a primary heat absorbing means or heat sink as indicated at 7A'. Specifically, the heat source 5A' is shown to be a nuclear reactor comprised of a plurality of elongate tubes 25 extending into, through, and out of container 3A'. Contained within tubes 25 are quantities of fissionable material (not shown). Also contained within the bundle of tubes 25 are modulating rods, as indicated at 27, for regulating or controlling the nuclear reaction. Each of the tubes 25 is provided with a porous or capillary outer surface 29 for distribution of liquified vapor (e.g., liquid lithium metal or the like) so as insure stable surface film evaporation of the liquid metal for carrying heat from tubes 25 to the heat absorbing means 7A'. It will be understood that the liquid distribution surfaces 29 on tubes 25 may be constituted by a suitable high performance fibrous ceramic material or by a metallic foam structure in good heat transfer relation with tubes 25. It will be further understood that suitable baffles, channels and other flowpaths constituting return system W' may be provided in the heat absorbing means for the return of liquid condensate from heat sink surfaces 7A' and for the relatively uniform distribution of the liquified heat transfer medium over the porous or capillary surfaces 29 of tubes 25.

Again, nuclear reactor apparatus 1A' is provided with auxiliary sets of heat absorbing coils 21' and 23' for absorbing excess heat produced by the nuclear reactor source 5A'. It will be understood that this apparatus utilizes the first heretofore mentioned propert of heat pipes in that high heat fluxes from the nuclear reactor tubes 25 can be transferred to the working medium (i.e., to the lithium contained within container 3A') and that these high heat fluxes can readily and efficiently be transferred to the heat absorbing means 7A'. Also, by selective operation of regulating coils 21' and 23', the thermal power generated by apparatus 1A' can be held constant.

In an atomic nuclear reactor using the heat exchange system of the present invention, the fissionable material generates vast amounts of heat. The heat sink is constituted by tubes through which is circulated an inert gas, such as helium, and the heat transfer medium is a liquid metal, such as lithium, which vaporizes on the tubes carrying the fissionable material, which rises to the heat sink tubes, which condenses thereon, and which returns by gravity to the surfaces of the heat source tubes containing the fissionable material. The heat source, the heat sink, and the intermediate heat transfer medium of this system are disposed within a containment vessel and, as such, constitute the primary heat exchanger of an atomic power plant.

An object of the present invention is to provide an atomic nuclear reactor system that possesses the virtues of compactness, simplicity, reliability, high temperature operation, and safety. Because of the non-flow nature of the heat exchange medium (i.e., the liquid metal), radioactivity can be confined to the interior of the containment vessel. Because the system can be regulated to operate at atmospheric pressure, there can be no catastropic coolant pipe rupture which results in loss of the reactor cooling medium. Thus, even though one of the coolant tube sets ruptured, the other tube sets would still be in heat transfer relation with the reactor core via the heat transfer working medium and heat could continue to be removed from the core.

As shown in FIG. 5, atomic fuel can be entered into or removed from the core without physically opening the containment 3A' or shutting down the reactor. Because of the two wall heat exchange system (i.e., the walls of tubes 25 and of the walls of tubes 7A') and the intervening fluid, the spread of radioactive contamination can be slowed thus considerably extending the operating life of an atomic power plant. Since no water or other alien elements enters the containment system, there can be no hydrogen explosion within the reactor. The danger of a melt-down in a run-away reactor can be substantially eliminated by enabling fissionable material to be selectively removed from certain critical tubes 25 during operation of the reactor.

Figure 6:
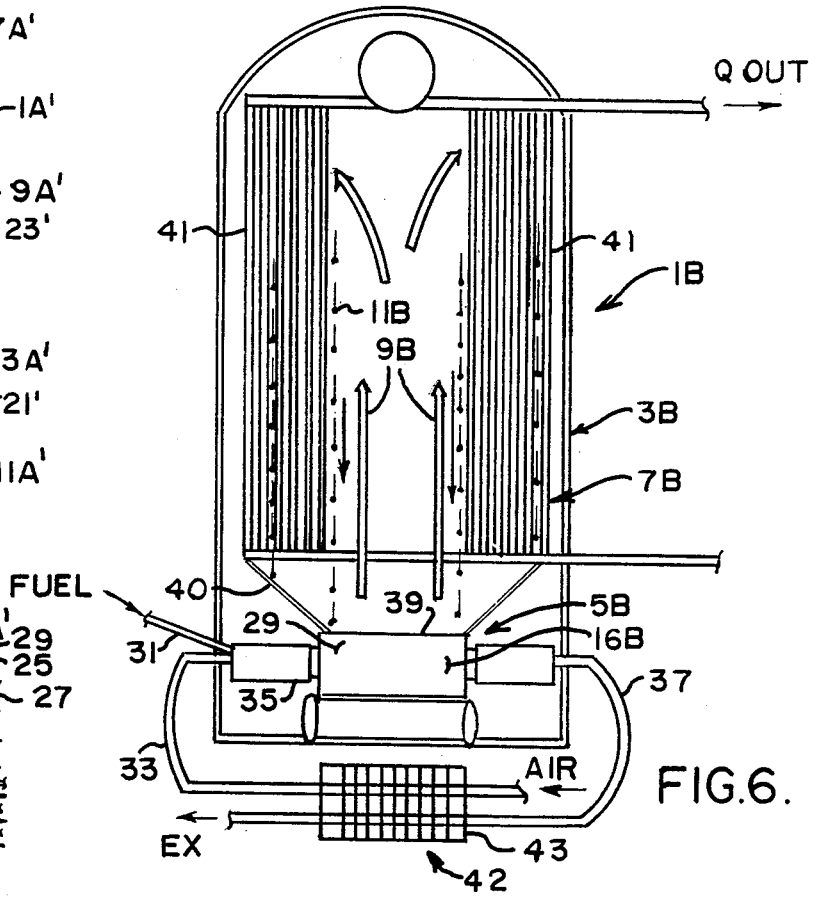
FIG. 6 is a semi-diagrammatic view of another embodiment of the apparatus of the present invention in which fuel is combusted in a combustion chamber contained within the heat transfer container and wherein the heat contained in the products of combustion exhausted from the flue is utilized in a regenerator to heat the incoming combustion air.

Referring now to FIG. 6, still another emodiment of the apparatus of the present invention is depicted in its entirety by reference character 1B. This embodiment of applicant's apparatus is shown to be a highly efficient steam generator or boiler using a combustion heat source. Generally, apparatus 1B includes a closed container, as generally indicated at 3B, that further includes an exothermal a heat source, as generally indicated at 5B, and a heat absorber 7B.

Heat source 5B is shown to comprise a closed combustion chamber 29 into which fuel (e.g., pulverized coal, oil, natural gas) is introduced via a fuel tube 31 and into which combustion air is introduced via an air tube 33. The fuel and air are mixed in proper proportion in a mixing chamber 35 and are combusted in combustion chamber 29. The products of combustion are then removed from the combustion chamber and from the interior of closed container 3B by means of a flue stack 37 and are exhausted to the atmosphere.

In accordance with the instant invention, the exterior of combustion chamber 29 and of at least a portion of flue stack 37 constitute heat exchange surfaces, at indicated at 39. These heat exchange surfaces 39 are covered with a suitable wicking material or the like 16B (such as heretofore described) for the distribution of liquid heat transfer working medium contained within container 3B so as to insure the stable film vaporization of the heat transfer working medium on the heat transfer surfaces 39 of the combustion chamber and of the flue gas stack.

The vaporized heat transfer working medium is then conveyed, as shown by the arrows 9B, so as to contact the outer surfaces of a plurality of condensation or steam tubes 41 constituting heat sink 7B through which a heat transfer fluid, such as water or the like, is circulated. Upon condensation of the vaporized heat transfer working medium on the steam tubes, the water therewithin is superheated so as to form steam. Of course, the steam may be circulated out of container 3B and utilized to drive an electrical generator or the like (not shown). The liquid water is then returned into the container 3B so as to circulate through the steam tubes.

As indicated generally at 11B, the liquified condensate returns by gravity to the heat transfer surfaces 39 of combustion chamber 29 and the heat transfer surfaces of the flue stack 37 for vaporization. Again, various distribution baffles and ducts 40 may be provided within container 3B as to uniformly distribute the liquified condensate over the heat tranfer surfaces 39 of the heat source.

Further in accordance with this invention, a regenerator, as generally indicated at 42, is provided for extracting the maximum amount of heat from the products of combustion from combustion chamber 29 prior to their being exhausted to the atmosphere. In essence, regenerator 42 extracts heat from the exhaust gases and transfers the heat to the combustion air as the latter is ducted into chamber 3B via combustion air intake 33. Preferably, regenerator 42 utilizes the heat transfer apparatus and method of the present invention to transfer heat from the flue gases to the combustion air.

Specifically, regenerator 42 comprises a closed container 43 with a portion of flue stack 37 extending therethrough. Further, combustion air inlet tube 33 passes through the container. A suitable heat transfer working medium is contained in container 43 and the portion of stack flue 37 therewithin constitutes a heat source and the portion of combustion air 33 within container 43 constitutes a heat sink. A suitable heat transfer working medium within container 43 is vaporized on the surface of the portion of flue stack tube 39 and the vapor is condensed upon the surface of the combustion air duct 33 thereby to remove heat from the stack gases and to transfer this heat to the combustion air as the latter is ducted into the combustion chamber. In this manner, the efficiency of the combustion process is maximized.

Additionally, in the steam generator indicated at 1B, it will be noted that the products of combustion remain isolated from steam tubes 41. This eliminates a prime concern with combustion steam generators in that fouling of the steam tubes is avoided while improving dramatically the rate of heat transfer between the combustion process and the steam tubes. This eliminates a large maintenance requirement of the steam generator.

Figure 7:
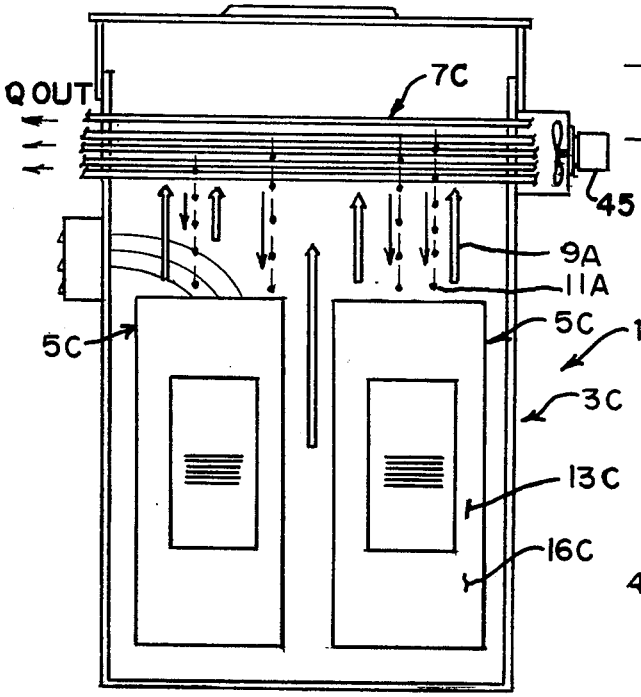
FIG. 7 is a semi-diagrammatic view of an electrical transformer in which the primary and secondary coils and cores of the transformer constitute the heat source of the heat transfer apparatus of the present invention and in which a plurality of open tubes having air blown therethrough constitutes the heat sink whereby unwanted heat expelled by the transformer is transferred to the atmosphere.

Referring now to FIG. 7, the heat transfer apparatus and method of the present invention is shown in an application for removing heat from the primary and secondary coils of a large electrical transformer 1C and for discharging this heat to the atmosphere. Transformer 1C includes a closed casing 3C in which is contained one or more transformer coils, as indicated at 5C. In operation, the transformer coils give off heat when stepping down or stepping up alternating current and thus constitutes a heat source. As indicated generally at 7C, a plurality of tubes pass through the walls of casing 3C. A fan, as indicated at 45, is provided for blowing air through the interior of tubes 7C and for exhausting the air to the atmosphere. It will thus be understood that tubes 7C thus constitute a heat sink. Further in accordance with this invention, a quantity of a suitable heat transfer working medium is provided within casing 3C for being vaporized on the surfaces of transformer coils 5C, for being conveyed to heat sink 7C (as indicated by arrows 9C), for being condensed on the surfaces of tubes 7C, for heating the air flowing therethrough, and for the return of the liquid condensate, as indicated by droplets 11, to the heat transfer surfaces of the transformer coils 5C.

Figure 8:
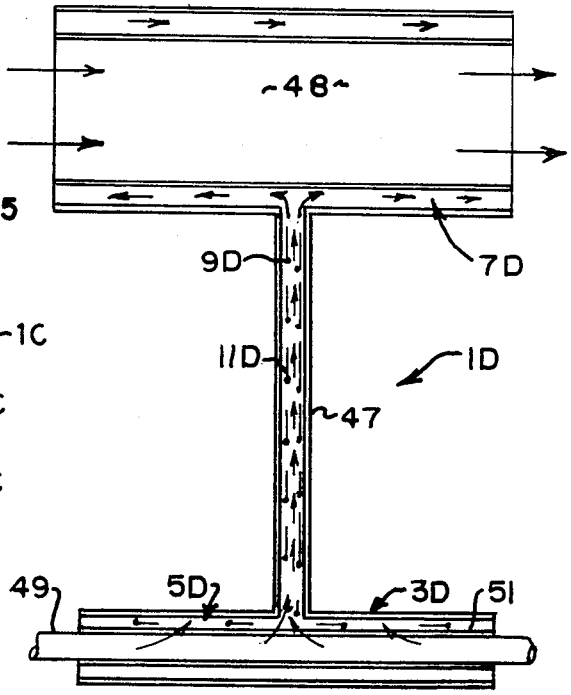
FIG. 8 is a semi-diagrammatic view in which hot liquid flowing through a pipe constitutes the heat source of the apparatus of the present invention, in which the vapor evaporated from the surface of the hot pipe is transported to a heat transfer surface constituting an oven or other heated surface (such as a cooking grill or the like), and in which the heated surfaces of the heat sink are maintained at a constant temperature.

In FIG. 8, another application of the heat transfer apparatus and method of the present invention is illustrated in its entirety by reference character 1D. This apparatus is shown to comprise a constant temperature oven which is constituted by a closed container 3D, having a heat source portion, as indicated generally at 5D, and a heat absorbing portion, as indicated generally at 7D, with a vapor/condensate passageway 47 interconnecting the heat source section and the heat absorbing section. The heat absorbing section 7D is shown to be in the form of a hollow tube with the interior of this tube constituting an oven or the like, as indicated generally at 48. The heat source is shown to be constituted by a tube 49 through which a hot liquid or steam may be circulated. In the alternative, the heat source may be an electric heater or the like. As shown in FIG. 8, the outer surfaces of tube 49 is provided with a capillary or porous surface 51 for the uniform distribution of liquid heat transfer medium over the outer surface of tube 49 so as to insure stable film evaporation of the heat transfer medium. Upon vaporization, the heat transfer medium flows naturally upwardly through passageway 47 and around the heat absorbing section 7D so as to uniformly condense on the inner surfaces of the oven. Hence, the interior walls of the oven are maintained at a constant or uniform temperature. The liquid condensate then flows by gravity back down of passage 47 and is distributed by means of baffles, tubes, or the like over the surface 51 of heat source tube 49. It will be particularly noted that this embodiment of the apparatus of the instant invention, makes full use of the property of heat pipes known as temperature flattening in that a constant temperature of the oven is readily achieved. Also, it will be noted that the heat source may be located remotely from the heat sink and that the heat source may be of a considerably different size or area than the heat sink. It will be further understood that, rather than the constant temperature of an oven, the apparatus of this invention could readily be adapted to form a cooking griddle or like.

Figure 9:
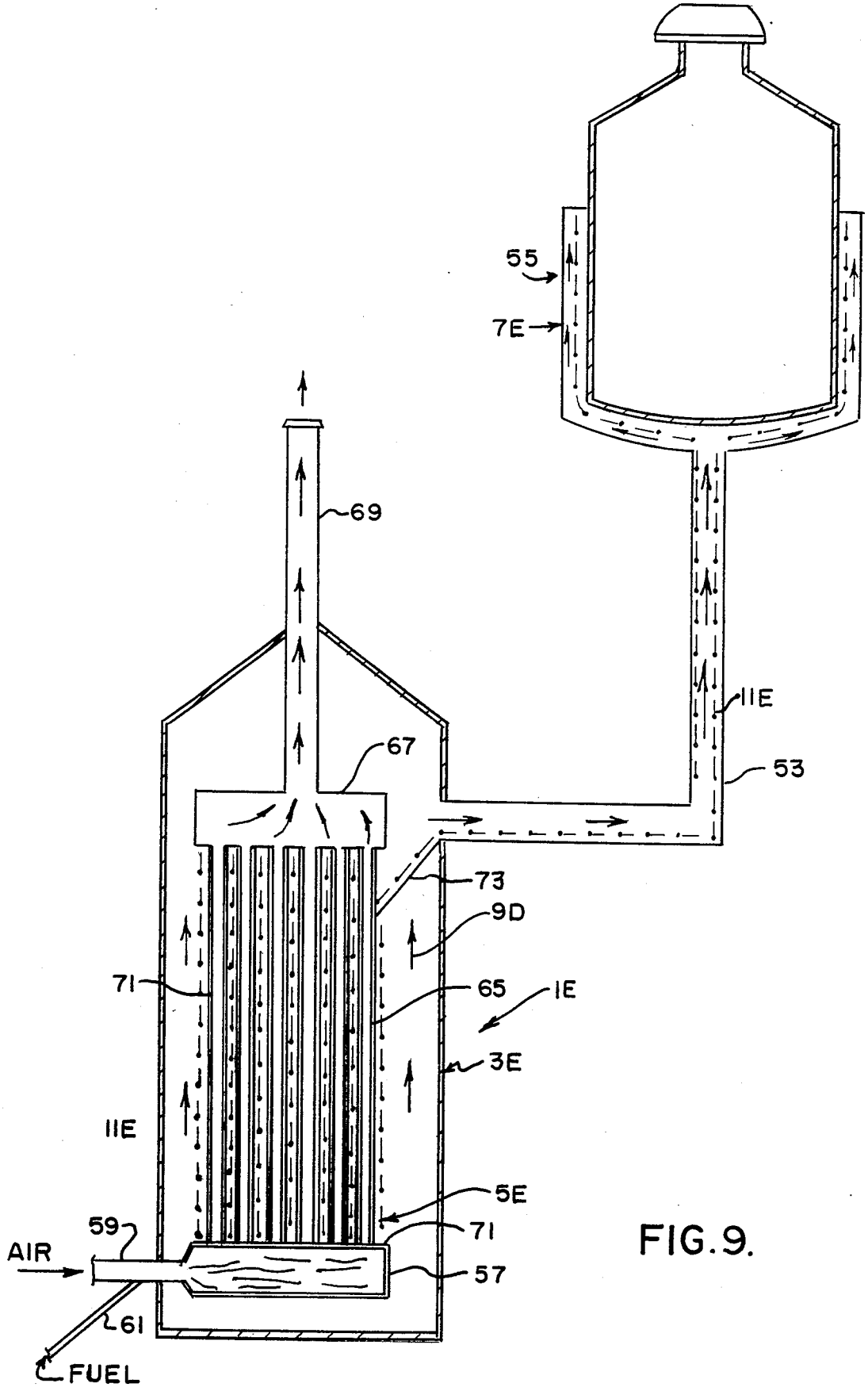
FIG. 9 is a semi-diagrammatic view of a heating system in which a fuel is combusted within a closed container, in which the products of combustion are ducted through fire tubes having a capillary surface along their outer surfaces, in which a working medium is evaporated on the surfaces of the fire tubes, in which the vapor is transported to a remote site heat absorber such as a chemical vessel or, a heat radiator or the like and in which the liquid condensate is returned to the capillary surfaces of the fire tubes.

Lastly, referring to FIG. 9, still another embodiment of the apparatus of this invention as indicated in its entirety at reference character 1E. Here, the apparatus is shown to comprise a closed container 3E, including a vapor/condensate conduit 53 interconnecting the main portion of the container and a heat sink portion, as indicated at 55, for the circulation of vapor and condensate between the heat source 5E and the heat sink 7E.

In FIG. 9, heat source 5E is shown to comprise a combustion chamber 57 which is fed by air through a combustion air duct 59 and which is fed by fuel through a fuel line 61 into a mixing chamber 63. The air/fuel mixture is then combusted within combustion chamber 57 and the products of combustion are ducted out of the container 3E by means of fire tubes 65. The individual fire tubes 65 are then manifolded to a flue gas header 67 and the flue gases are exhausted from container 3E by means of a flue 69.

In accordance with this invention, the outer surfaces of fire tubes 65 and the outer surfaces of combustion chamber 57 have thereon, a porous or capillary structure, as indicated at 71, for the uniform distribution of liquid heat transfer working medium on the outer surfaces of the fire tubes so as to insure the stable film evaporation of the liquified heat transfer medium. Upon vaporization, the heat transfer working medium vapor, as indicated by arrows 9D, is conveyed through intermediate conduit 53 to the heat absorber 7E. Of course, the vapor condenses on the heat absorbing surfaces of the heat sink and the liquified condensate, as indicated by droplets 11E, returns by gravity to the heat source. A baffle 73 is provided for distributing the liquified condensate over the capillary surfaces 71 of fire tubes 65 and of combustion chamber 57. As shown, the heat absorber is transferring heat to a chemical vessel used in a chemical process or the like. However, it will be recognized that the apparatus of the present invention as shown in FIG. 9, could be utilized to constitute a heating system in a building or the like wherein the heat generating portion of the apparatus constitutes a furnace and wherein the heat absorbing portion of the apparatus constitutes radiators distributed throughout the building.

In view of the above, it will be seen that the several objects and features of this invention are achieved and other advantageous results obtained.

As various changes could be made in the above constructions and methods without departing from the scope of the invention, it is intended that all matters contained in the above description are shown in the accompanying drawings shall be as illustrative and not in a limiting sense.

What is claimed is:

1. Heat transfer apparatus comprising a closed container enclosing therewithin the following a heat source constituting a first set of tubes having a heat transfer surface thereon; means for ahsorbing heat located apart from said heat source said heat absorbing means comprising a second set of tubes having a heat absorbing heat transfer surface thereon; said first and second sets of tubes having suitable heat transfer substances circulating therethrough for conveying heat to and for removing heat from the apparatus; and a heat transfer working medium which is capable of being surface film evaporated by said heat source, being conveyed to heat absorbing means, being condensed on said heat absorbing means, and being conveyed back to said heat source; the quantity of said medium contained within said container being sufficient to permit said surface film evaporation on said heat transfer surface of said heat source, said heat transfer surface of said heat source and said heat absorbing surface of said heat absorbing means being selectively variable independently of the configuration of said container thereby to permit the areas of said heat transfer surface and said heat absorbing surfaces to be optimized, means for forming on said heat transfer surface of said heat source a film of said liquid heat transfer medium thereover for the surface film evaporation thereof, and means for conveying liquid heat transfer medium from said heat absorbing means to said heat transfer surface of said heat source.

2. Heat transfer apparatus as set forth in claim 1 further comprising means for distributing said medium over said heat transfer surface of said heat source for said surface film evaporation thereon.

3. Heat transfer apparatus as set forth in claim 2 wherein said distributing means comprises a capillary material on said heat transfer surface of said heat source.

4. Heat transfer apparatus as set forth in claim 1 further comprising means for returning said condensed medium from said heat absorbing means to said heat source.

5. Heat transfer apparatus as set forth in claim 1 wherein said heat source comprises an exothermal process contained with said container.

6. The process of heat transfer within a closed container, said container having therein a heat source having a heat transfer surface thereon, heat absorbing means having a heat absorbing surface located remotely from said heat source, and a quantity of a heat transfer working medium sufficient to insure surface film evaporation on said heat transfer surface of said heat source without undue accumulation of liquid working medium within said closed container when the process is operated under steady state conditions, said heat transfer surface of said heat source and said heat absorbing surface of said heat absorbing means being substantially thermally isolated from said container and being selectively variable independently of the configuration of said container, said process comprising the steps of:

forming a film of liquid heat transfer medium on the heat transfer surface of said heat source;

surface film evaporating said medium on said heat transfer surface of said heat source substantially independently of the configuration of said container;

conveying said medium to said heat absorbing means;

condensing said medium on the surface of said heat absorbing means substantially independently of the configuration of said container; and returning said medium to said heat transfer surface of said heat source for forming said film thereon.

7. The heat transfer process as set forth in claim 6 further comprising distributing said medium over said heat transfer surface of said heat source.

8. Heat transfer apparatus comprising a closed container enclosing therewithin the following: a heat source having a heat transfer surface thereon; means having a heat absorbing surface for absorbing and transferring heat to the outside of said container, said absorbing and transferring means being located apart from said heat source; and a heat transfer working medium within said container of such a quantity so as to permit surface film evaporation thereof on the heat transfer surface of said heat source, with said working medium being conveyed to said heat absorbing and transferring means for condensation on said heat absorbing surface, and means for transporting liquid working medium from said heat absorbing surfaces back to said heat source; means for forming on said heat transfer surface of said heat source a film of said liquid heat transfer medium thereon for said surface film evaporation of said heat transfer medium; the quantity of said medium contained within such container being sufficient to permit said vaporization on said heat transfer surface of said heat source and to prevent the undue buildup of pressure within said container as the medium is continuously vaporized on the surface of the heat source and condensed on the surface of the heat absorbing means, the areas of said heat transfer surface of said heat source and of said heat absorbing surface of said heat absorbing and transfer means being selectively variable independently of the configuration of said container thereby to substantially vary the heat transfer capability of said apparatus without changing said container.

9. The process of heat transfer within a closed container having therein the following: said container having a combustion heat source located entirely within said container independent of said container, said combustion heat source having a heat transfer surface thereon, heat absorbing means located remotely from said combustion heat source and having a heat absorbing surface, and a quantity of a heat transfer working medium within said container sufficient to insure surface film evaporation on said heat transfer surface of said combustion heat source without undue accumulation of liquid working medium within said closed container and to insure that undue pressure levels are not present within said closed container during operation, said process comprising the steps of:

combusting a fuel within said combustion heat source located within said container;

surface film evaporating said medium on said heat transfer surface of said combustion heat source;

conveying said medium to said heat absorbing means;

condensing said medium on the surface of said heat absorbing means;

returning said medium to said heat transfer surface of said heat source; and forming a film of said medium on said heat transfer surface of said heat source for the surface film evaporation of said medium thereon.

10. Heat transfer apparatus comprising a closed container having therein the following: a combustion heat source located entirely within said container independent of said container, said combustion heat source having a heat transfer surface thereon, heat absorbing means located within said container remote from said combustion heat source and having a heat absorbing surface, means for forming a film of said liquid heat transfer medium on said heat transfer surface of said combustion heat source, a quantity of heat transfer working medium within said container sufficient to ensure surface film evaporation on said heat transfer surface of said combustion heat source without undue accumulation of liquid heat transfer working medium within said container, and means for transporting liquid heat transfer medium from said heat absorbing surface to said film forming means, said heat transfer working medium being evaporable on all surfaces of said combustion heat source heat transfer surfaces independently of said container.

* * * * *